US008297338B2

(12) United States Patent
Ueno et al.

(10) Patent No.: US 8,297,338 B2
(45) Date of Patent: Oct. 30, 2012

(54) SAND CORE FOR CASTING AND PROCESS FOR PRODUCING THE SAME

(75) Inventors: Mitsuaki Ueno, Tochigi (JP); Hiromi Fujita, Tochigi (JP); Keita Yoshiara, Tochigi (JP); Ken Tomeba, Ohtawara (JP); Hiroshi Furusawa, Aichi (JP)

(73) Assignee: Honda Motor Co., Ltd., Tokyo (JP)

( * ) Notice: Subject to any disclaimer, the term of this patent is extended or adjusted under 35 U.S.C. 154(b) by 61 days.

(21) Appl. No.: 12/992,295

(22) PCT Filed: Apr. 15, 2009

(86) PCT No.: PCT/JP2009/001735

§ 371 (c)(1),
(2), (4) Date: Jan. 14, 2011

(87) PCT Pub. No.: WO2009/139113

PCT Pub. Date: Nov. 19, 2009

(65) Prior Publication Data

US 2011/0094697 A1 Apr. 28, 2011

(30) Foreign Application Priority Data

May 15, 2008 (JP) ..... 2008-128049

(51) Int. Cl.
*B22D 46/00* (2006.01)
*B22C 9/10* (2006.01)

(52) U.S. Cl. ..... 164/4.1; 164/15; 164/369

(58) Field of Classification Search ..... 164/4.1, 164/15, 369, 14, 33
See application file for complete search history.

(56) References Cited

FOREIGN PATENT DOCUMENTS

| | | | |
|---|---|---|---|
| JP | 03-189049 | | 8/1991 |
| JP | 10-230343 | | 9/1998 |
| JP | 10-230343 | A * | 9/1998 |
| JP | 2003-117634 | | 4/2003 |
| JP | 2003-117634 | A * | 4/2003 |
| JP | 2007-105738 | | 4/2007 |
| JP | 2007-136475 | | 6/2007 |

* cited by examiner

*Primary Examiner* — Kevin P Kerns
(74) *Attorney, Agent, or Firm* — Rankin, Hill & Clark LLP

(57) ABSTRACT

In the sand core 10, the tar reducing agent is included in at least the second coating layer 13, which is the outermost layer, of the coating layers 12 and 13. Thus, the tar, which may be generated from the core body 11 and the coating layers 12 and 13 which are positioned thereinside, can be decomposed into low molecular gases (carbon monoxide, carbon dioxide, water, and the like) by heat of the molten metal. As a result, generation of the tar from the sand core 10 to the outside can be prevented. In this case, since the layer which includes the tar reducing agent is the second coating layer 13 which directly contacts the molten metal, the second coating layer 13 can directly receive the heat of the molten metal, and the tar generation prevention effects can be thereby remarkably obtained. Therefore, generation of defects in cast products which may be caused by clogging in the gas drain can be prevented, and structures of the gas drain of the die and the surroundings thereof can be simplified.

5 Claims, 5 Drawing Sheets

(Prior Art)

SAND CORE FOR CASTING AND PROCESS FOR PRODUCING THE SAME

TECHNICAL FIELD

The present invention relates to a casting sand core having a coating layer which coats a surface of a core body, and relates to a production method therefor. In particular, the present invention relates to an improvement in the coating layer.

BACKGROUND ART

In casting using a die casting method, when a hollow portion is formed in a cast product, a sand core, which has a shape corresponding to that of the cast product, is used. For example, in casting using a die casting die 100 shown in FIG. 8, after a sand core 200 is disposed in a cavity 101, die clamping is performed such that a movable die 110 is fixed to a fixing die 120. Molten aluminum is supplied in the cavity 101 at high pressure and high speed, and the molten aluminum is cooled and solidified. In this case, the pressure in the cavity 101 is reduced via a pressure reduction passage 121 in advance, so that a gas therein is discharged and the molten aluminum is supplied. In supplying the molten aluminum and thereafter, remaining gas in the cavity 101 and gas generated from the molten aluminum are discharged via gas drain slits 113 and 123 and a gas vent 122 which are gas drains. Reference numerals 111 and 112 in FIG. 8 are sliding dies which are slidably provided at the movable die 110.

The sand core 200 used in this high pressure casting is equipped with a core body formed such that particles of silica sand (including $SiO_2$ as a main component) or the like are connected by an organic binder of phenolic resin or the like. A surface of the sand core 200 is covered with a coating layer. The coating layer is formed in order to prevent infiltration of the molten metal into the core body and to allow easy separation of the cast product and the sand core. In particular, in the casting using the above die casting method, the molten metal is supplied at high pressure, so that the coating layer is important for preventing infiltration of the molten metal into the core body. This coating layer includes the organic binder in order to connect main components thereof (for example, fire-resistant powdered materials or mica) to each other and to connect the coating layer and the core body.

The temperature of the above organic binder in the core body and the coating layer (in particular, in the coating layer) increases in the casting and the organic binder combusts, so that the organic binder is decomposed into low molecular gases (carbon monoxide, carbon dioxide, water, and the like), and the low molecular gases are discharged via the gas drain slits 113 and 123 and the gas vent 122.

However, tar, soot, and the like may be generated by incomplete combustion of the organic binder. In particular, the pressure in the cavity 101 is reduced in the above manner, air and oxygen may not be supplied from the outside to the cavity 101, and the sand core 200 is integrally cast with aluminum which is a material of the molten metal, so that oxygen is insufficient in the surroundings of the sand core 200. Due to this, incomplete combustion of the organic binder may occur, and tar, soot, and the like may be generated, so that they may adhere to the gas drain slits 113 and 123 and the gas vent 122 which are gas drains. Thus, clogging may occur therein, so that gas discharge may be inhibited, and defects may be generated in cast product due to gas entrapment.

In order to prevent clogging in the gas drains, various techniques have been proposed. For example, as disclosed in Japanese Unexamined Patent Application Publication No. 2007-105738, a technique has been proposed in which a duct plug, which is composed of an oxygen nonstoichiometric ceramic, is disposed in a gas drain. In the technique in Japanese Unexamined Patent Application Publication No. 2007-105738, a tar, which is in a gas circulating in the gas drain, is reacted with oxygen discharged from the ceramic, and the tar thereby burns. Thus, the tar is decomposed into low molecular gases (carbon monoxide, carbon dioxide, water, and the like), and the low molecular gases are discharged via the gas drain.

As disclosed in Japanese Unexamined Patent Application Publication No. 2007-136475, a technique has been proposed in which a molten metal infiltration prevention pin is inserted in a gas drain such that a predetermined interval is formed between the molten metal infiltration prevention pin and an inner peripheral surface of the gas drain, and a blade is provided on a peripheral surface of the molten metal infiltration prevention pin. In the technique in Japanese Unexamined Patent Application Publication No. 2007-136475, rotation of the molten metal infiltration prevention pin is driven, and tar adhering to the gas drain is removed by the blade provided on the peripheral surface of the molten metal infiltration prevention pin.

However, in the technique in Japanese Unexamined Patent Application Publication No. 2007-105738, it is necessary to furthermore provide the duct plug to the die, and it is also necessary to use a member such as a heating device to burn the tar in the gas drain. In the technique in Japanese Unexamined Patent Application Publication No. 2007-136475, the blade is furthermore provided on the peripheral surface of the molten metal infiltration prevention pin inserted in the gas drain. In the techniques in Japanese Unexamined Patent Application Publications Nos. 2007-105738 and 2007-136475, it is necessary to furthermore provide the tar removing member in the gas drain or the surroundings thereof. Due to this, the structure may be complicated.

DISCLOSURE OF THE INVENTION

An object of the present invention is to provide a casting sand core that can prevent generation of defects in cast products which may be caused by clogging in a gas drain and that enables the gas drain and the surroundings thereof to be simplified, and an object of the present invention is to provide a production method therefor.

According to one aspect of the present invention, a casting sand core has: a core body; a coating layer which covers a surface of the core body, wherein the coating layer has an outermost layer, and a tar reducing agent is included in at least the outermost layer of the coating layer. For example, the tar reducing agent is an oxidant which can decompose tar into carbon monoxide, carbon dioxide, and water by receiving heat.

In the casting sand core of the present invention, since the tar reducing agent is included in at least the outermost layer of the coating layer, tar, which may be generated from the core body and the coating layer, can be decomposed into low molecular gases (carbon monoxide, carbon dioxide, water, and the like) by heat of molten metal, and generation of the tar from the sand core to the outside can be thereby prevented. In this case, since the layer which includes the tar reducing agent is the outermost layer of the coating layer which directly contacts the molten metal, the outermost layer can directly receive the heat of the molten metal, and the tar generation prevention effects can be thereby remarkably obtained. As a result, adhesion of tar and soot to a gas drain can be prevented, so that generation of defects in cast products which may be caused by clogging in the gas drain can be prevented. Since the above effects can be obtained by including the tar reducing agent in at least the outermost layer of the coating layer, it is unnecessary to provide a tar removing member in the gas drain of die or the surroundings thereof. Therefore, structures of the gas drain of the die and the surroundings thereof can be simplified.

The casting sand core of the present invention can use various structures. For example, the coating layer may include an organic binder, and an inclusion ratio of the tar reducing agent, which is included in the outermost layer of the coating layer, to the organic binder may be 5 to 60 wt %. In a case in which the inclusion ratio of the tar reducing agent to the organic binder included in the organic binder is less than 5 wt %, the tar generation prevention effects by the tar reducing agent cannot be sufficiently obtained. In a case in which the inclusion ratio of the tar reducing agent to the organic binder included in the organic binder exceeds 60 wt %, when the outermost layer of the coating layer is a layer which includes a lubricity provision material, the lubricity provision action of the layer cannot be sufficiently obtained, so that it may be difficult to remove the cast product from the casting sand core. Therefore, in order that the tar generation prevention effects by the tar reducing agent can be sufficiently obtained and removal of the cast product from the casting sand core can be performed easily, it is desirable that the coating layer may include the organic binder, and the inclusion ratio of the tar reducing agent, which is included in the outermost layer of the coating layer, to the organic binder may be 5 to 60 wt %.

The coating layer may have a first coating layer and a second coating layer. The first coating layer may cover the surface of the core body and may include a powdered refractory. The second coating layer may cover a surface of the first coating layer and may include a lubricity provision material. In this case, the tar reducing agent may be included in at least the second coating layer.

According to another aspect of the present invention, a production method for a casting sand core is provided. The casting sand core has: a core body; a coating layer which covers a surface of the core body. The production method includes the step of: including a tar reducing agent at at least an outermost layer of the coating layer. The production method for a casting sand core of the present invention can obtain the same actions and effects as those of the casting sand core of the present invention.

The production method for a casting sand core of the present invention can use various structures. For example, according to one preferred embodiment of the production method, the production method may include the step of: tar reducing agent ratio determination for determining an inclusion ratio of the tar reducing agent in the outermost layer of the coating layer. The tar reducing agent ratio determination may include the steps of: test piece production in which plural slurries, which have different inclusion ratios of the tar reducing agent and are used for forming at least the outermost layer of the coating layer, are prepared, an inside layer of the coating layer is formed on each surface of plural alloys which are oxidation-resistant, and each slurry is coated on each inside layer on the plural alloy, so that test pieces having the outermost layer of the coating layer are produced with respect to each inclusion ratio of the tar reducing agent; generation amount measurement vessel production in which after at least one of the test pieces is disposed in a tubular vessel having a bottom, an opening of the vessel is closed by using glass wool of which weight is measured in advance, so that the vessel is produced as a generation amount measurement vessel for pyrolysate; pyrolysate generation in which the generation amount measurement vessel is heated for a desired time period in a furnace having an atmosphere at which a temperature is set at a temperature corresponding to that of a molten metal used in a die, so that pyrolysate is generated; tar generation amount measurement in which after the pyrolysate generation is performed on each generation amount measurement vessel, weight of the glass wool used as a cap of the generation amount measurement vessel is measured, and tar generation amount is obtained based on the weight of the glass wool with respect to each inclusion ratio of the tar reducing agent; and lubricity provision action evaluation in which an index showing lubricity provision action of the outermost layer is evaluated with respect to each inclusion ratio of the tar reducing agent. In this case, each inclusion ratio of the tar reducing agent may be determined based on the tar generation amount which is obtained in the tar generation amount measurement and the index showing the lubricity provision action of the outermost layer which is evaluated in the lubricity provision action evaluation. The index showing the lubricity provision action is an action which prevents seizure between the molten metal (for example, molten aluminum alloy) and the sand core and which makes sand discharge characteristics good.

An area ratio of spots, which may be formed by the tar reducing agent on the surface of the outermost layer of the coating layer, to the surface of the outermost layer thereof can be used as the index showing the lubricity provision action. This index may show that when the area ratio of spots of the tar reducing agent to the surface of the outermost layer is smaller, the lubricity provision action by the outermost layer is greater, that is, when the area ratio of spots of the tar reducing agent to the surface of the outermost layer is larger, the lubricity provision action by the outermost layer is smaller.

In this preferred embodiment, the inclusion ratio of the tar reducing agent, which enables the outermost layer of the coating layer to exert desirable tar generation prevention effects and desirable lubricity provision action, can be obtained based on the tar generation amount obtained in the tar generation amount measurement and the index showing the lubricity provision action of the outermost layer.

For example, according to another preferred embodiment of the production method, the coating layer may include an organic binder, and an inclusion ratio of the tar reducing agent, which is included in the outermost layer of the coating layer, to the organic binder may be 5 to 60 wt %. In this embodiment, the same actions and effects as those of the above embodiment of the casting sand core can be obtained.

According to the casting sand core or the production method therefor, since the tar reducing agent is included in at least the outermost layer of the coating layer, generation of the tar from the sand core to the outside can be prevented. As a result, adhesion of tar and soot to a gas drain can be prevented, and another effect can be obtained.

EXPLANATION OF REFERENCE NUMERALS

Figure 1:
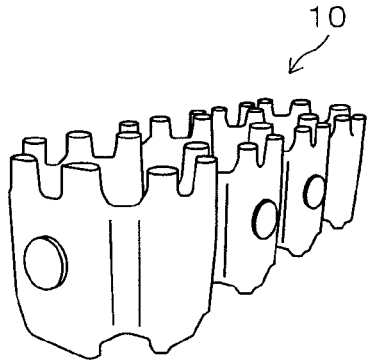
FIG. 1 is a perspective view showing a structure of a casting sand core of an embodiment according to the present invention.

Reference numeral 10 denotes a casting sand core, 11 denotes a core body, 12 denotes a first coating layer (coating layer, inside layer), and 13 denotes a second coating layer (coating layer, outermost layer).

BEST MODE FOR CARRYING OUT THE INVENTION

1. Structure of Embodiment

An embodiment of the present invention will be described with reference to the Figures hereinafter. FIG. 1 is a perspective view showing a structure of a casting sand core 10 of an embodiment according to the present invention. The casting sand core 10 (hereinafter simply referred to as "sand core 10") is used when a cylinder block (not shown in the Figures), which is a component of an internal-combustion engine provided in an automobile body, is produced as a cast product. A hollow portion, which is formed in the cylinder block by the sand core 10, functions as a water jacket portion.

Figure 2:
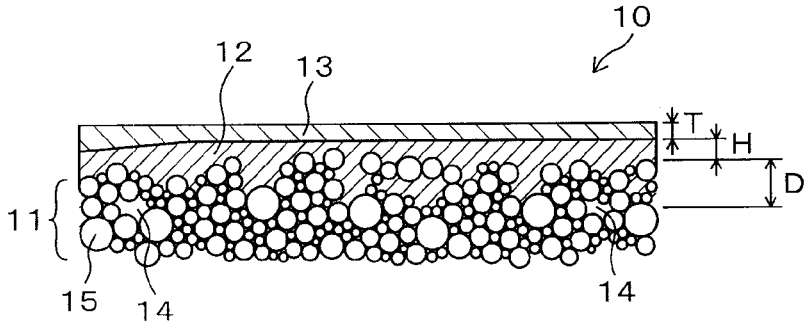
FIG. 2 is an enlarged cross sectional view showing a structure of a surface neighborhood of the casting sand core in FIG. 1.

FIG. 2 is an enlarged cross sectional view showing a structure of a surface neighborhood of the sand core 10. The sand core 10 has a core body 11. A surface of the core body 11 is covered with a first coating layer 12, and a surface of the first coating layer 12 is covered with a second coating layer 13. In FIG. 2, reference numeral 14 denotes a closed pore which is not filled with the first coating layer 12 and remains in the core body 11.

The core body 11 is formed such that particles 15 (silica sand, Naigai Cerabeads, and the like), which are relatively spherical, are bound by an organic binder (phenolic resin (not shown in FIG. 2) or the like). Naigai Cerabeads includes about 98% of composite oxide of $SiO_2$ and $Al_2O_3$, and the name is the trade name of artificial sand sold by Itochu Ceratech Corporation. The rate of thermal expansion of Naigai Cerabeads is much less than those of zircon sand, chromite sand, silica sand, and the like which are typical core sands. Thus, the thermal expansion of the core body 11 is small during supplying of a molten metal in casting, so that crack generation in the core body 11 can be prevented. The deflective strength of the core body 11 is relatively high, and it is about 10 MPa.

The first coating layer 12 is formed such that particles of zircon flour, which is a powdered refractory, are bound to each other by an organic binder (phenolic resin or the like). Regarding the zircon flour, ones different from each other in average particle diameter (for example, large particle diameter zircon flour having a particle diameter of about 10 μm and small particle diameter zircon flour having a particle diameter of about 1 μm) are desirably mixed. Liquid glass is not included in the first coating layer 12.

The lower portion of the first coating layer 12 is embedded in the core body 11. The depth D of the embedded portion of the first coating layer 12 in the core body 11 is about 0.5 mm which is sufficient. The distance H from the surface of the core body 11 to the upper end surface of the first coating layer 12 is set in order that infiltration of the molten metal to the core body 11 can be prevented and the breakability of the sand core 10 may not be deteriorated, and the distance H is desirably set to be 0.2 mm to 0.5 mm.

Thus, the first coating layer 12 is embedded in the core body 11, so that pores at the surface neighborhood of the core body 11 are closed. Thus, the infiltration of the molten metal into the core body 11 can be prevented. That is, since penetration of the molten metal into the core body 11 can be avoided, removal of the cast product from the sand core 10 can be performed easily. The size precision of the cast product can be improved, and skin irritation due to contact with the cast product can be prevented. In particular, since particles having different average particle diameters are mixed as a powdered refractory, a powdered refractory having a small particle diameter is mainly used, so that filling of the powdered refractory into the pores at the surface neighborhood of the core body 11 can be reliably performed. A powdered refractory having a large particle diameter is mainly used, so that the first coating layer 12 can be formed on the surface of the core body 11.

The second coating layer 13 includes a mica having the lubricity provision action and a tar reducing agent inhibiting generation of tar. The second coating layer 13 may include an organic binder (phenolic resin or the like), and the binding of the second coating layer 13 and the first coating layer 12 is thereby strong, so that peeling of the second coating layer 13 from the first coating layer 12 can be prevented. The thickness T of the second coating layer 13 may be set in order to sufficiently provide the lubricity provision action allowing easy removal of the cast product from the sand core 10. For example, the thickness T is about 0.1 mm. In this case, there are almost no pores in the first coating layer 12, so that the second coating layer 13 is not embedded in the first coating layer 12.

The tar reducing agent is an oxidizing agent. For example, the tar reducing agent is an oxide and an inorganic compound. In this case, the oxide is composed of at least one metal element selected from the group consisting of Fe, Cu, Ni, Co, Zn, Mn, Al, V, Ti, Sn, and Pb, and the inorganic compound is composed of at least one metal element selected from the group consisting of alkali metal oxyacid salt. Since the tar reducing agent generates oxygen by the heat of the molten metal, the tar can be decomposed into low molecular gases (carbon monoxide, carbon dioxide, water, and the like).

As described above, since the second coating layer 13, which is the outermost layer and includes the mica, has lubricity provision action, removal of the cast product from the sand core 10 can be performed easily. Since the second coating layer 13, which is the outermost layer and includes the tar reducing agent, decomposes the tar, which is generated from the core body 11 and the first coating layer 12 positioned inside the second coating layer 13, to low molecular gases (carbon monoxide, carbon dioxide, water, and the like) by heat of the molten metal, generation of the tar from the sand core 10 can be prevented. In particular, since the second coating layer 13 is the outermost layer contacting the molten metal, the tar generation prevention effects can be remarkably obtained. It is desirable that the inclusion ratio of the tar reducing agent, which is included in the second coating layer 13, to the organic binder in the coating layers 12 and 13 be 5 to 60 wt %. Thus, the tar generation prevention effects can be sufficiently obtained, and removal of the cast product from the sand core 10 can be performed easily.

2. Production Method of Embodiment

Figure 3:
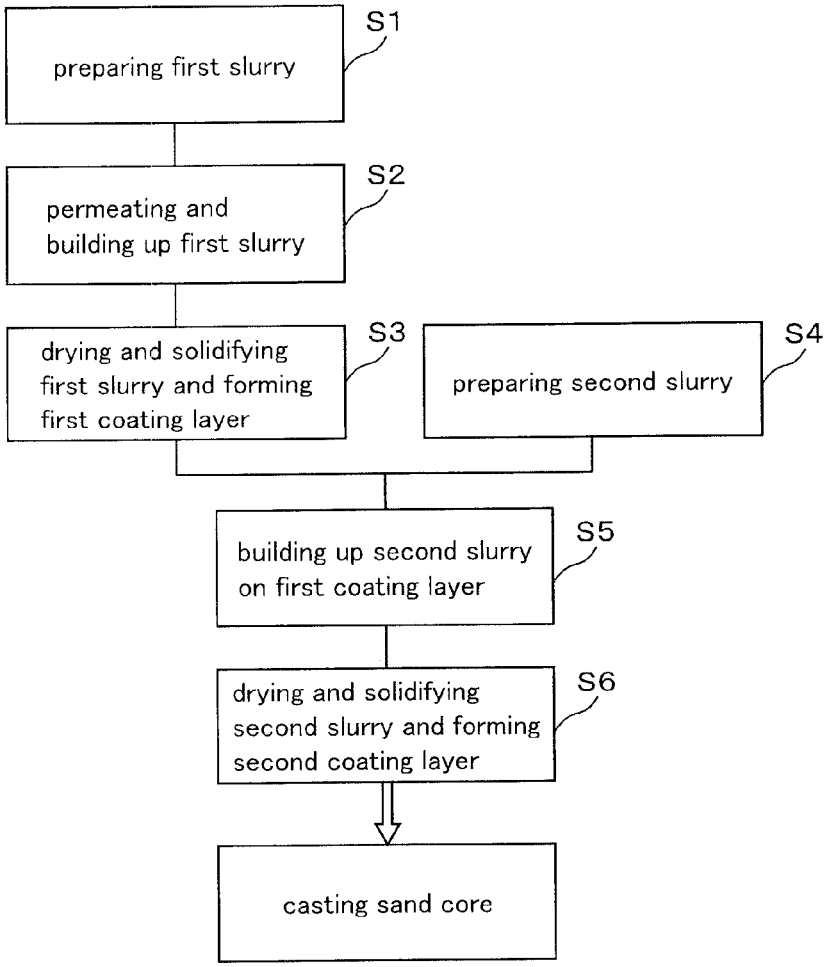
FIG. 3 is a flow chart showing processes of a production method for the casting sand core in FIG. 1.

Next, a production method of the sand core 10 will be explained primarily with reference to FIG. 3. FIG. 3 is a flow chart showing processes of a production method for the sand core in FIG. 1.

First, in first process S1, zircon flour, which is refractory, phenolic resin, which is an organic binder, a wetting agent, an antifoaming agent, and octyl alcohol are mixed with water. Thus, a slurry for a first coating layer (hereinafter simply referred to as "first slurry") is produced. In this case, generation of foam, which may be caused by the wetting agent, is inhibited by the antifoaming agent. Large particle diameter zircon flour having a particle diameter of about 10 μm and small particle diameter zircon flour having a particle diameter of about 1 μm are desirably used.

Next, in second process S2, a surface of the core body 11 is soaked in the first slurry, and it builds up on the surface of the core body 11. The soak time period is set in accordance with the viscosity of the first slurry in order that the first slurry can sufficiently permeate in the core body 11 and the thickness H of the first coating layer 12 be about 0.2 to 0.5 mm. In the build up of the first slurry, various coating methods (spray coating, brush painting, or the like) may be used instead of the soak.

When the large particle diameter zircon flour having an particle diameter of about 10 μm and the small particle diameter zircon flour having an particle diameter of about 1 μm are used as zircon flour, the small particle diameter zircon flour in the first slurry mainly flows into pores of the core body 11. Thus, the pores can be filled at a high filling rate. On the other hand, a large portion of the large particle diameter zircon flour does not flow into the pores, and it builds up at the surface of the core body 11. Since the first slurry has a good wettability by the wetting agent in the first slurry, the first slurry desirably adheres to the surface of the sand core 10. Since octyl alcohol is a planarization agent, the build up thickness of the first slurry and the thickness H of the first coating layer 12 are approximately uniform. Thus, the first slurry includes refractory having different particle diameters, so that the pores of the core body 11 can be embedded and a layer of the first slurry can be formed on the surface of the core body 11.

Next, in third process S3, the core body 11 is taken out, and the first slurry is dried and solidified, so that the first coating layer 12 having the thickness H of about 0.2 to 0.5 mm is formed. In this case, by the phenolic resin, the refractories in the first coating layer 12 are bonded with each other, and the core body 11 and the first coating layer 12 are strongly bonded with each other.

While the above first process S1 to the third process S3 are performed, in fourth process S4, a mica, a tar reducing agent, LUBRICATE (having film forming ability), a wetting agent, an antifoam agent, and octyl alcohol are mixed with water. In this case, if necessary, a phenolic resin may be included as an organic binder. For example, the mix ratio of the tar reducing agent is determined in advance by one method example shown by the following EXAMPLES. Thus, a slurry for a second coating layer (hereinafter simply referred to as "second slurry") is produced. The "LUBRICATE" is trade name sold by OTAKEGAISHI CORPORATION.

Next, in fifth step S5, a surface of the first coating layer 12 is soaked in the second slurry, so that the second slurry builds up on the surface of the first coating layer 12. In the build up of the second slurry, various coating methods (spray coating, brush painting, or the like) may be used instead of the soak.

Finally, in sixth process S6, the second slurry is dried and solidified, so that second coating layer 13 is formed on the surface of the first coating layer 12. The first process S1 to the sixth process S6 are performed, so that the sand core 10 is formed to be structured such that first the coating layer 12 and the second coating layer 13 are formed on the core body 11 in turn.

3. Action of Embodiment

Figure 4:
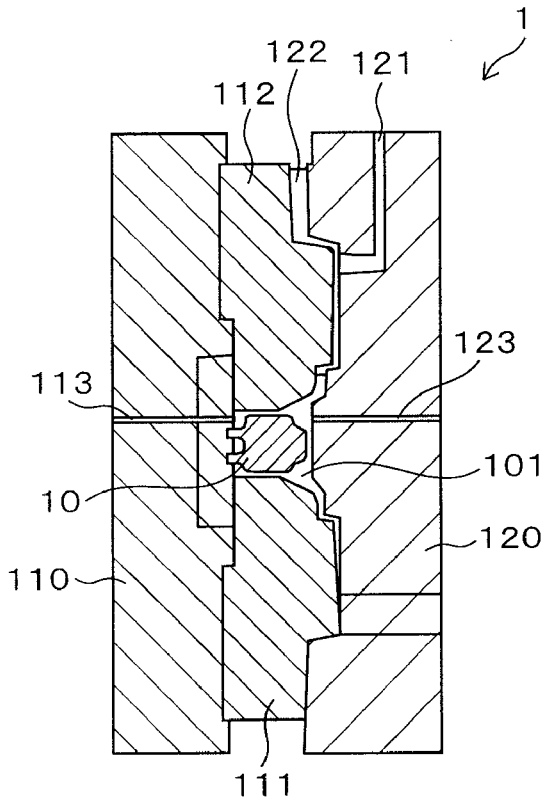
FIG. 4 is a side cross sectional view showing a structure of a die casting die using the casting sand core in FIG. 1.
Figure 8:
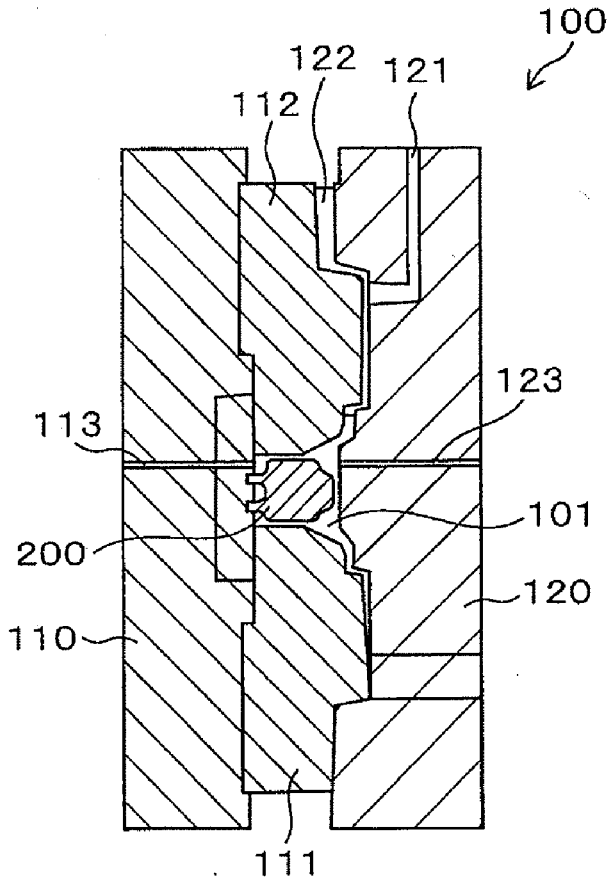
FIG. 8 is a side sectional view showing a structure of a die casting die using the conventional casting sand core.

An example using the sand core 10 in a die casting die 1 shown in FIG. 4 will be explained with reference to the Figures. The die 1 shown in FIG. 4 has the same construction as the die casting die 100 shown in FIG. 8 other than using of the sand core 10 in the cavity 101 instead of the sand core 200, so that in the die 1, the same reference numerals are used for the same components as in the die casting die 100, and the explanation of the same components will be omitted.

In casting using the die casting die 1, molten aluminum having a temperature of about 600 degrees C. is supplied in the cavity 101 at high pressure (about 100 MPa) and high speed (about 2.5 m/sec), and the molten aluminum is cooled and solidified. In this case, the pressure in the cavity 101 is reduced via the pressure reduction passage 121 in advance, so that a gas therein is discharged and the molten aluminum is supplied therein. In the supplying of the molten aluminum and thereafter, remaining gas in the cavity 101 and gas generated from the molten aluminum are discharged via the gas drain slits 113 and 123 and the gas vent 122 which are gas drains.

In this case, the pressure in the cavity 101 is reduced in the above manner, air or oxygen is not supplied from the outside to the cavity 101, and the sand core 10 is integrally cast with aluminum which is a material of the molten metal, so that oxygen is insufficient in the surroundings of the sand core 10. Due to this, incomplete combustion of the organic binder in the core body 11 and in the coating layers 12 and 13 may occur. In particular, tar, soot, and the like may be generated from the coating layers 12 and 13.

However, in the sand core 10 of this embodiment, since the tar reducing agent is included in at least the second coating layer 13, which is the outermost layer, of the coating layers 12 and 13, the tar, which may be generated from the core body 11 and the coating layers 12 and 13, can be decomposed into low molecular gases (carbon monoxide, carbon dioxide, water, and the like) by heat of the molten metal, and generation of the tar from the sand core 10 to the outside can be thereby prevented. In this case, since the layer which includes the tar reducing agent is the second coating layer 13 which directly contacts the molten metal, the second coating layer 13 can directly receive the heat of the molten metal, and the tar generation prevention effects can be thereby remarkably obtained. As a result, adhesion of the tar and the soot to the gas drain slits 113 and 123 and the gas vent 122, which are gas drains, can be prevented, so that generation of defects in cast products which may be caused by clogging in the gas drain can be prevented.

In the embodiment, since the above effects can be obtained by including the tar reducing agent in at least the second coating layer 13 of the coating layers 12 and 13, it is unnecessary to provide a tar removing member in the gas drain of the die 1 or the surroundings thereof. Therefore, structures of the gas drain of the die 1 and the surroundings thereof can be simplified. In particular, since the inclusion ratio of the tar reducing agent, which is included in the second coating layer 13, to the organic binder in the coating layers 12 and 13 may be 5 to 60 wt %, the tar generation prevention effects can be sufficiently obtained, and removal of the cast product from the sand core 10 can be performed easily.

4. Modification Example

The present invention is explained by using the above embodiment, the present invention is not limited to the above embodiment, and various modifications can be made in the present invention. For example, in the above embodiment, the present invention is used for high-pressure casting using the die casting method. Alternatively, the present invention may be used for low-pressure die casting (LPDC) or gravity die casting (GDC). In the above embodiment, the tar reducing agent is included in only the second coating layer 13. Alternatively, the tar reducing agent may be also included in the first coating layer 12. In the above embodiment, the second coating layer 13 is formed on the entire surface of the first coating layer 12. Alternatively, the second coating layer 13 may be formed at only portion which is not easily removed from the cast product. In this case, the tar reducing agent is also included in the first coating layer 12. In the above embodiment, one example using a cylinder block as a cast product is explained. Alternatively, the present invention can be used for products other than the cylinder block as a cast product.

The supply method of the molten metal in the casting of the above embodiment is not limited to the above feature, and various modifications can be made in the present invention. For example, molten aluminum may be stirred and cooled, and an aluminum alloy burette having a desired structure may be produced in advance. The alloy burette may be melted, and semi-molten aluminum alloy having a solid phase and a liquid phase which are mixed may be supplied as a molten metal. Alternatively, molten aluminum may be stirred and cooled, and a semi-solidified aluminum alloy having a desired structure may be produced. The semi-solidified aluminum alloy may be supplied as a molten metal.

EXAMPLES

The embodiments of the present invention will be explained in detail hereinafter with reference to concrete examples. In the examples, in order to examine the amount of tar generated from the first coating layer and the second coating layer of that of tar generated from the core body, the first coating layer, and the second coating layer, the first coating layer and the second coating layer were formed on a SUS (Steel Use Stainless of the Japanese Industrial Standard) plate which does not generate tar, test pieces were produced, and the amount of tar generated from each test piece was measured.

A. Production method for Test Piece

First, a SUS plate (having a length of 70 mm, a width of 15 mm and a thickness of 15 mm) was heated to a high temperature of 400 degrees C. for an hour, so that contamination (oil and the like) was removed from the SUS plate. Next, after the SUS plate was cooled, cleaning using alcohol was performed on the SUS plate. Next, dipping using a first slurry liquid, which was produced in advance, was performed on the SUS plate. In this case, the dipping was performed several times so that the coating amount of the first slurry liquid arrived at a predetermined amount.

The first slurry liquid included: 3 vol % (with respect to water) of PELEX OT-P (5 vol %) produced by Kao Corporation; 0.3 vol % (with respect to water) of SN DEFOAMER B (old name: FOAMASTAR B) produced by SAN NOPCO LIMITED; 0.3 vol % (with respect to water) of octyl alcohol produced by Godo Co., Ltd.; 4 wt % (with respect to zircon flour) of EG-4000 produced as an organic binder by LIGNYTE CO., LTD.; 400 wt % (with respect to water) of A-PAX 45M produced by KINSEI MATEC CO., LTD.; and 200 wt % (with respect to water) of zircon flour #350 produced by KINSEI MATEC CO., LTD. The phrase "with respect to water" denotes that mix ratio of the material to the water, and the phrase "with respect to zircon flour" denotes that mix ratio of the material to the zircon flour.

Next, after the SUS plate was dried naturally, drying by heating was performed on the SUS plate in a drying furnace (at a temperature of 200 degrees C. for 30 minutes). Next, the SUS plate was removed from the drying furnace and the SUS plate was cooled naturally, so that a first coating layer was formed on the SUS plate.

Next, dipping using second slurry liquid (mix ratio of tar reducing agent is 0 to 20 wt % (with respect to water)), which was produced in advance, was performed on the SUS plate having the first coating layer formed thereon. In this case, the dipping was performed several times so that the coating amount of the second slurry liquid arrived at a predetermined amount.

Regarding the second slurry liquid, the water solution included: 3 vol % (with respect to water) of PELEX OT-P (5 vol %) produced by Kao Corporation; 0.3 vol % (with respect to water) of SN DEFOAMER B (old name: FOAMASTAR B) produced by SAN NOPCO LIMITED; 0.3 vol % (with respect to water) of octyl alcohol produced by Godo Co., Ltd.; 60 wt % (with respect to water) of bronze mica GC-1000 produced by KIRARA Corporation; and 50 wt % (with respect to water) of LUBRICATE No. 0 produced by OTAKEGAISHI CORPORATION: The tar reducing agent (copper oxide) was added to the water solution such that a mix ratio of the tar reducing agent (with respect to water) was changed from 0 to 20 wt %, and the second slurry liquid was obtained.

Figure 5:
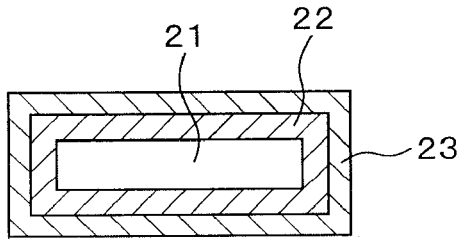
FIG. 5 is a cross sectional view showing a structure of test piece used in the example.

Next, after the SUS plate was dried naturally, drying by heating was performed on the SUS plate in a drying furnace (at a temperature of 150 degrees C. for 30 minutes). Next, the SUS plate was removed from the drying furnace and the SUS plate was cooled naturally, so that a second coating layer was formed on the first coating layer formed on the SUS plate. In the above manner, as shown in FIG. 5, the test pieces were produced such that the first coating layer 22 and the second coating layer 23 were formed on the SUS plate 21.

B. Tar Generation Amount Measurement

The tar generation amount measurement using the above test pieces was performed. First, after test piece was disposed in a glass test tube (having an inner diameter of 16 mm and a length of 180 mm), glass wool (having a weight of 180 mg) weighed in advance was inserted into an opening neighborhood of the test tube. Thus, generation amount measurement vessel of pyrolysate was produced. Next, after the above measurement vessel was disposed into a tubular heating furnace in which the temperature was maintained at 600 degrees C., and heating was performed on the measurement vessel for 6 minutes, the measurement vessel was taken out from the tubular heating furnace, and it was allowed to stand and cool to room temperature. Next, the glass wool was removed from the measurement vessel, and the mass of the glass wool was measured. In this case, the tar generation amount (unit: mg) was calculated by subtracting the mass (unit: mg) of the glass wool before the heating from the mass (unit: mg) of the glass wool after the heating.

C. Tar Generation Amount Reducing Evaluation

Figure 6:
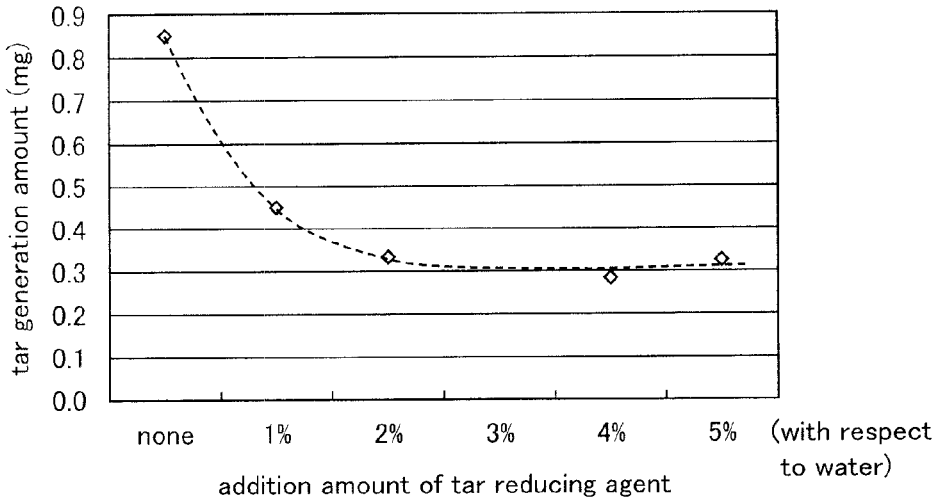
FIG. 6 is a graph showing measurement results of tar generation amount in the example.
Figure 7:
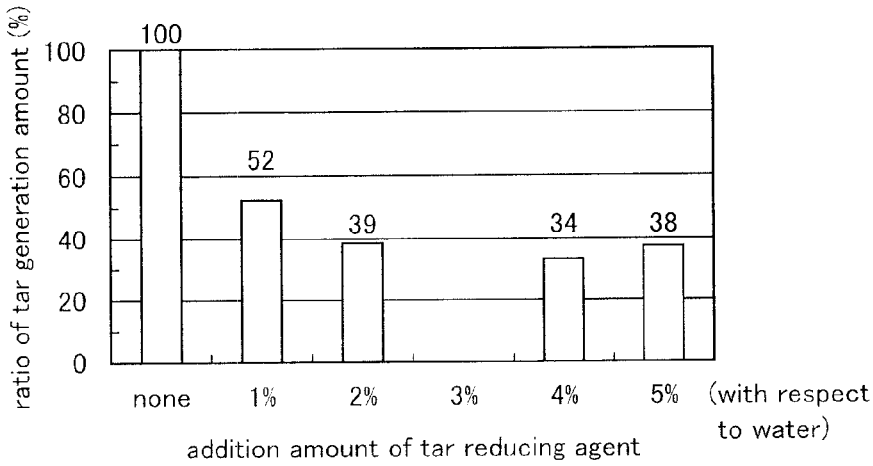
FIG. 7 is a graph showing measurement results of tar generation amount and for comparing the tar generation amount of each test piece which is obtained by using the tar generation amount of the test piece, in which a tar additive was not added, as a standard (=100%).

Since the organic binder, which was a tar generating source, was included in the first coating layer 22, the tar generation amount reducing evaluation was performed based on the tar generation amount (unit: mg) per gram of the first coating layer. The results are shown in FIGS. 6 and 7. FIG. 6 is a graph showing measurement results of tar generation amount (unit: mg) per gram of the first coating layer. FIG. 7 is a graph showing measurement results of tar generation amount and for comparing the tar generation amount of each test piece which is obtained by using the tar generation amount of the test piece, in which a tar additive was not added, as a standard (=100%). In FIGS. 6 and 7, the unit of the added amount of the tar reducing agent is described as "%", and the description shows weight ratio (wt %) of the tar reducing agent to water.

When the amount of the tar reducing agent added to the second coating layer 23 was larger, the tar generation amount was gradually reduced. As shown in FIGS. 6 and 7, when the inclusion ratio of the tar reducing agent was 1 wt % (with respect to water), the tar generation amount was rapidly reduced. 1 wt % of the tar reducing agent (with respect to water) corresponds to about 5 wt % of the weight of the organic binder included in the first coating layer 22. When the inclusion ratio of the tar reducing agent was 2 wt % (with respect to water) or more, the tar generation amount was approximately constant at reduction amount of 60%. Therefore, it was confirmed that the tar generation prevention effects can be obtained sufficiently when the inclusion ratio of the tar reducing agent was 1 wt % (with respect to water) or more. It was confirmed that spots became prominent on the surface of the second coating layer 23, and the lubricity provision action of the second coating layer 23 cannot be obtained sufficiently when the inclusion ratio of the tar reducing agent exceeded 10 wt % (with respect to water). 10 wt % of the tar reducing agent (with respect to water) corresponds to about 60 wt % of the organic binder included in the first coating layer 22.

Therefore, the inclusion ratio of the tar reducing agent of the second coating layer is set at 1 to 10 wt % (with respect to water), that is, the inclusion ratio of the tar reducing agent of the second coating layer with respect to the weight of the organic binder included in the coating layer is set at 5 to 60 wt % (with respect to water), so that the tar generation prevention effects can be obtained sufficiently, and removal of the cast product from the sand core can be easily performed.

The invention claimed is:

1. A casting sand core comprising:

a core body; and a coating layer which covers a surface of the core body;

wherein a lower portion of the coating layer is embedded in the core body, and a tar reducing agent is included in at least an outermost layer of the coating layer.

2. The casting sand core according to claim 1, wherein the coating layer includes an organic binder, and wherein an inclusion ratio of the tar reducing agent, which is included in at least the outermost layer of the coating layer, to the organic binder is 5 to 60 wt %.

3. A production method for a casting sand core, wherein the casting sand core comprises:

a core body; and a coating layer which covers a surface of the core body, wherein a lower portion of the coating layer is embedded in the core body;

the production method comprising the step of:

including a tar reducing agent in at least an outermost layer of the coating layer.

4. The production method according to claim 3, wherein the coating layer includes an organic binder, and wherein an inclusion ratio of the tar reducing agent, which is included in at least the outermost layer of the coating layer, to the organic binder is 5 to 60 wt %.

5. A production method for a casting sand core, wherein the casting sand core comprises:

a core body; and a coating layer which covers a surface of the core body, wherein the coating layer includes an organic binder and at least an outermost layer of the coating layer includes a tar reducing agent;

the production method comprising determining an inclusion ratio of the tar reducing agent in at least the outermost layer of the coating layer to the organic binder, wherein the tar reducing agent ratio determination comprises the steps of:

test piece production in which plural slurries, which have different inclusion ratios of the tar reducing agent and are used for forming at least the outermost layer of the coating layer, are prepared, an inside layer of the coating layer is formed on each surface of plural alloys which are oxidation-resistant, and each slurry is coated on each inside layer on the plural alloys, so that test pieces having the outermost layer of the coating layer are produced with respect to each inclusion ratio of the tar reducing agent;

generation amount measurement vessel production in which after at least one of the test pieces is disposed in a tubular vessel having a bottom, an opening of the vessel is closed by using glass wool of which weight is measured in advance, so that the vessel is produced as a generation amount measurement vessel for pyrolysate;

pyrolysate generation in which the generation amount measurement vessel is heated for a desired time period in a furnace having an atmosphere at which a temperature is set at a temperature corresponding to that of a molten metal used in a die, so that pyrolysate is generated;

tar generation amount measurement in which after the pyrolysate generation is performed on each generation amount measurement vessel, weight of the glass wool used as a cap of the generation amount measurement vessel is measured, and tar generation amount is obtained based on the weight of the glass wool with respect to each inclusion ratio of the tar reducing agent; and lubricity provision action evaluation in which an index showing lubricity provision action of the outermost layer is evaluated with respect to each inclusion ratio of the tar reducing agent, wherein each inclusion ratio of the tar reducing agent is determined based on the tar generation amount which is obtained in the tar generation amount measurement and the index showing the lubricity provision action of the outermost layer which is evaluated in the lubricity provision action evaluation.

* * * * *